United States Patent [19]

Halldórsdóttir

[11] Patent Number: 4,984,299

[45] Date of Patent: Jan. 15, 1991

[54] CUFF FOR USE WHEN WORKING WITH LIQUID MATERIAL AT A LEVEL ABOVE SHOULDER HEIGHT

[76] Inventor: Hildur Halldórsdóttir, P.O. Box 355, S-53302, Götene, Sweden

[21] Appl. No.: 399,509

[22] PCT Filed: Mar. 11, 1988

[86] PCT No.: PCT/SE88/00127

§ 371 Date: Sep. 20, 1989

§ 102(e) Date: Sep. 20, 1989

[87] PCT Pub. No.: WO88/08260

PCT Pub. Date: Nov. 3, 1988

[51] Int. Cl.[5] ..... A41B 7/00; A41B 7/12

[52] U.S. Cl. ..... 2/16; 2/59; 2/60; 2/160; 2/162; 2/167; 15/227; 15/248 R

[58] Field of Search ..... 2/16, 21, 59, 60, 160, 2/161 R, 162, 164, 168, 169, DIG. 5; 15/227, 248 R

[56] References Cited

U.S. PATENT DOCUMENTS

| | | | |
|---|---|---|---|
| 815,998 | 3/1906 | Wolff | 2/60 X |
| 829,784 | 8/1906 | Hawkins | 15/248 R |
| 924,545 | 6/1909 | Emmert | 2/162 X |
| 1,149,674 | 8/1915 | Nichols | 2/59 |
| 1,177,412 | 3/1916 | Hopkins | 15/227 |
| 1,189,198 | 6/1916 | Groome | 2/59 X |
| 1,553,208 | 4/1925 | Gibson | 2/168 |
| 2,117,417 | 5/1938 | Hall et al. | 2/168 |
| 2,244,871 | 6/1941 | Guinzburg | 2/16 X |
| 2,299,855 | 10/1942 | Smith | 2/162 X |
| 2,638,599 | 5/1953 | Flink | 2/60 X |
| 2,641,767 | 6/1953 | Rosa | 2/168 |
| 2,821,718 | 2/1958 | Hau et al. | 2/168 X |
| 3,088,120 | 5/1963 | Gould | 2/DIG. 5 |
| 3,268,647 | 8/1966 | Hayes et al. | 2/168 X |
| 4,389,734 | 6/1983 | Franz et al. | 2/59 |

FOREIGN PATENT DOCUMENTS

| | | | |
|---|---|---|---|
| 1181330 | 6/1959 | France | 15/248 |
| 559082 | 3/1957 | Italy | 15/248 |

*Primary Examiner*—Werner H. Schroeder
*Assistant Examiner*—Jeanette E. Chapman
*Attorney, Agent, or Firm*—Sughrue, Mion, Zinn, Macpeak & Seas

[57] ABSTRACT

A protective cuff for preventing, when working with liquid material at a level above one's shoulders, the liquid material from flowing down onto the person working with the material is constituted by an outwardly open, funnel-like collar (1) of a relatively large rigidity at the inner end thereof somewhat yieldingly carried by a holder (2) forming a bottom for the collar and having a radially inner, axially elongated portion (5) of a soft material and of a relatively small thickness directly enclosing the user's forearm.

10 Claims, 1 Drawing Sheet

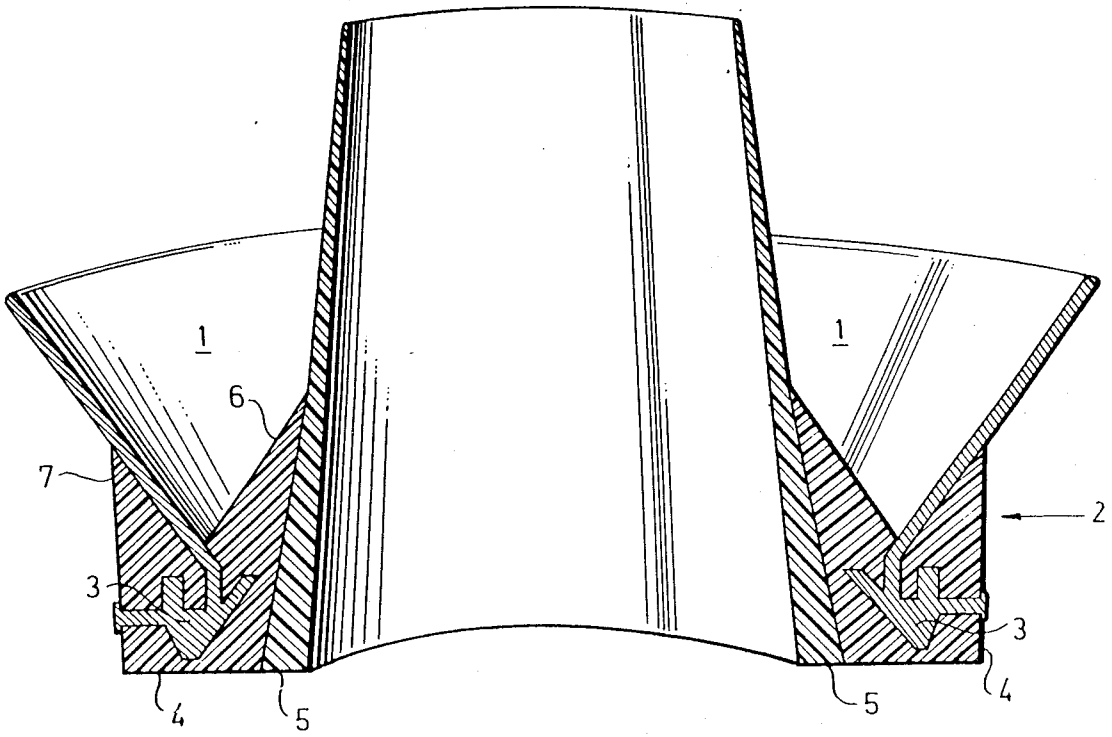
2
3
4
5
1
5
6
1
4
3
7

CUFF FOR USE WHEN WORKING WITH LIQUID MATERIAL AT A LEVEL ABOVE SHOULDER HEIGHT

BACKGROUND OF THE INVENTION

When working with liquid material at a level or height above one's shoulders, e.g., when washing or painting elevated objects or surfaces, one is often troubled by washing liquid or paint, etc., flowing from the tool downwardly along one's hand or arm. To eliminate such inconveniences special gloves having specially shaped cuffs or cuffs provided on tools to intercept flowing liquid have been proposed in the past. However, such previously known devices exhibited various disadvantages, e.g., they were inefficient, uncomfortable, too specialized or too expensive.

SUMMARY OF THE INVENTION

Hence, the present invention has as an object the provision of a device adapted to prevent, when working at a height above one's shoulders, the liquid material from flowing downwardly along one's arm via a tool or directly via one's hand. It is a further object that the device does not suffer from the disadvantages of previously known similar devices. Thus, when work of the kind indicated above is being carried out, the device effectively prevents the liquid material from flowing downwardly along one's arm and, at the same time, it is comfortable to the wearer without interfering with the work being carried out as desired. It is a still further object that the device be usable when carrying out many different kinds of work of the above-noted nature and under such conditions, that the device also be suited for inexpensive mass production. These objects are attained by the protective cuff according to the claims.

BRIEF DESCRIPTION OF THE DRAWING

An exemplary embodiment of the protective cuff according to the invention is described below in more detail with reference to the attached drawing the single FIGURE of which schematically and in longitudinal section shows a protective cuff according to the invention.

DETAILED DESCRIPTION OF THE PREFERRED EMBODIMENT

The protective cuff shown by the drawing consists of two main portions, viz. on the one hand a funnel-like collar 1 which, when work is being carried out with liquid material at a height above one's shoulders, is to intercept such material that tends to flow downwardly along one's arm from a tool or from one's hand and, on the other hand, a holder 2 with which collar 1 is connected and by which it is held on the user's arm.

In the embodiment shown in the FIGURE, collar 1, which preferably is made from a rather stiff, if somewhat flexible, plastic material, is manufactured as a separate portion anchored in holder 2 by an anchor portion 3 integral with collar 1 at an axially inner end thereof and labyrinthically shaped as shown, holder 2 as shown constituting a bottom for collar 1. From anchor portion 3, collar 1 extends outwardly from a preferably circular inner end, the diameter of which is slightly larger than the diameter of the wearer's forearm, while widening conically to a preferably circular distal end. The diameter of the distal end of collar 1 may vary with different designs depending on the nature of the work and the tool being used.

Holder portion 2 of the embodiment shown consists of two separate elements, viz. a radially outer portion 4 in which anchor portion 3 of collar 1 is anchored and a radially inner elongated portion 5 intended to directly enclose the user's forearm adjacent the user's wrist. The radially inner portion 5 is here shown having a slightly conical, outwardly tapering inside. Radially outer portion 4 of holder 2 is manufactured from a rigid, but to some extend flexible, plastic or rubber material so that it will securely but comfortably hold collar 1 in its intended position and with its intended orientation. The radially inner portion 5 of holder 2, on the other hand, is manufactured from a soft plastic or rubber material so that the user will perceive wearing the protective cuff as comfortable.

In order for holder 2 to yieldingly yet firmly carry the cuff on the wearer's arm, its radially inner portion 5 should both be of a relatively small radial thickness as shown by the drawing and be of a relatively large axial length. Thus, holder 2 has been found to hold collar 1 firmly yet comfortably if the yielding, radially inner holder portion 5 somewhat taperingly extends outwardly for some distance from the inner end of collar 1, preferably as far as somewhat beyond the distal end of collar 1 as shown by the FIGURE of the drawing. Also, the inner portion 5 widens somewhat, for a short distance beyond the inner end of the collar. The radially outer, more rigid portion 4 of holder 2 extends to the same extent inwardly from the inner end of collar 1 as does the inner portion 5, so that it will offer a radially outer support for the periphery of the inner portion 5 at the inner end thereof. Preferably, as shown, radially outer portion 4 of holder 2 also is provided with an outwardly tapering, conical section 6 extending within collar 1 for a distance outwardly along radially inner portion 5 of the holder, so that radially inner portion 5 will have an outer support for the portion of the length thereof outside the inner end of collar 1. The outer portion 4 is further provided with a section 7 having a radially outer cylindrical or slightly conical surface and a radially inner surface having the same taper as collar 1 and forming an outer support for a portion of collar 1 adjacent the inner end thereof. The sections 6 and 7 thus form a bifurcated outer end of the holder 2.

The shown design of a radially inner, yielding portion 5, of holder 2, including an elongated section of small and decreasing thickness which extends outwardly beyond collar 1 also is very advantageous in that it will permit a protective glove, for instance of thin plastic material, applied to the user's hand to be pulled down over the outer or distal end (i.e., the end remote with respect to the holder 2) of portion 5. Obviously, the glove and the protective cuff then together very efficiently will prevent liquid tending to flow downwardly along the user's hand, i.e., on the glove, from contacting the user's skin or clothes (e.g., liquid is prevented from running down the user's arm). As is immediately appreciated, such liquid will harmlessly collect in the inner or lower portion of the collar and in so doing will be effectively prevented from contacting the user's skin or clothes at any point.

The protective cuff according to the invention shown by the FIGURE of the drawing and described above may be modified and varied in many ways within the scope of the invention. Thus, the entire cuff may be manufactured as a one-piece unit of the same material provided that the portion forming collar 1 and portion 4 of holder 2 is suitably rigid with portion 5 of holder 2 being soft enough to afford the desired comfort. To bring this about, for instance during manufacture of the cuff holder, portion 5 may be made soft by making it porous or from lamella-like, mutually articulated members cooperating in an accordian-like manner. Portion 5 may also be manufactured according to either of these two methods when constituted by a separate portion which is not integral with portion 4 of the holder or, when it is not part of a one-piece unit forming both holder portion 4 and collar 1.

The protective cuff will work especially satisfactorily, whether or not it is manufactured as a one-piece unit or as two or three separate, interconnected elements, when holder portion 4, with respect to collar 1 and holder portion 5, is of an intermediate rigidity so as to permit it to hold collar 1 sufficiently firmly yet yieldingly.

The glove mentioned above may be adapted to be fixedly connected to the distal portion of holder portion 5.

I claim:

1. A protective cuff for preventing a liquid material from flowing downwardly along an arm of a user of the liquid material when work is being carried out with the liquid material at a height above a shoulder height of the user, said protective cuff comprising:

(a) a funnel-like outwardly open collar (1) for intercepting said liquid material, said collar including an axially inner end having an anchor portion (3) thereon and a conical portion which widens axially outwardly from said axially inner end to a distal end; and (b) a holder portion (2) adapted to firmly yet somewhat yielding support said collar on a forearm of the user, said holder portion including a radially outer portion (4) enclosing and supporting said anchor portion (3) of said collar to thereby constitute a bottom therefor, and a radially inner elongated portion (5) adapted to be fitted directly over and enclose a forearm of the user adjacent to a wrist of the user, said radially inner elongated portion being formed of a soft material.

2. The protective cuff according to claim 1, wherein said radially outer portion (4) is formed of a rigid, yet somewhat flexible, material as compared to said soft material of said radially inner elongated portion (5).

3. The protective cuff according to claim 2, wherein said rigid material is plastic.

4. The protective cuff according to claim 1, wherein said radially outer portion (4) engages a radially outer face of an axially inner portion of said radially inner elongated portion (5) to thereby support the same.

5. The protective cuff according to claim 1, wherein said radially outer portion (4) of said holder portion (2) is bifurcated at an outer end thereof and includes a radially outer section (7) having a generally cylindrical outer surface and a tapered inner surface which contacts an outer surface of said conical portion of said collar (1);

and further including a radially inner section (6) having a conical outer surface which extends between said collar and said radically inner elongated portion (5), and an inner surface which extends along at least a portion of said radially inner elongated portion (5).

6. The protective cuff according to claim 1, wherein said radially inner portion (5) of said holder portion (2) has a small radial thickness relative to said radially outer portion (4) of said holder portion.

7. The protective cuff according to claim 1, wherein said radially inner portion (5) of said holder portion (2) extends from an inner end of said holder portion and to an outer termination a short distance exteriorly of said distal end of said collar (1).

8. The protective cuff according to claim 1, wherein said radially inner portion (5) of said holder portion (2) is slightly conical and tapers from said axially inner portion thereof axially outwardly, and is adapted to permit a protective glove to be slipped over a distal end thereof.

9. The protective cuff according to claim 1, wherein said collar (1) is formed of a material having a relatively large stiffness yet somewhat yielding.

10. The protective cuff according to claim 1, wherein said cuff consists of three separately manufactured and mutually fixedly connecting portions: said portions consisting of said collar (1), said radially outer portion (4) of said holder portion (2), and said radially inner portion (5) of said holder portion.

* * * * *